United States Patent [19]

Takai

[11] 4,056,109

[45] Nov. 1, 1977

[54] HAIR-CURLER

[75] Inventor: Hisao Takai, Katano, Japan

[73] Assignee: Lucky Hair Products Co., Ltd., Yao, Japan

[21] Appl. No.: 696,710

[22] Filed: June 16, 1976

[51] Int. Cl.[2] ..... A45D 2/00

[52] U.S. Cl. ..... 132/40

[58] Field of Search ..... 132/40, 41 R, 42

[56] References Cited

U.S. PATENT DOCUMENTS

| | | | |
|---|---|---|---|
| 2,243,173 | 5/1941 | Smalley | 132/41 R |
| 2,625,940 | 1/1953 | Carper | 132/41 R |
| 2,646,053 | 7/1953 | Harris | 132/41 R |
| 2,758,604 | 8/1956 | Graf | 132/41 R |
| 3,250,281 | 5/1966 | Gresham et al. | 132/41 R |
| 3,340,880 | 9/1967 | Gresham et al. | 132/41 R |
| 3,696,820 | 10/1972 | Lara | 132/40 |
| 3,933,161 | 1/1976 | Strickman | 132/40 |
| 3,960,157 | 6/1976 | Andrews | 132/40 |

*Primary Examiner*—G.E. McNeill
*Attorney, Agent, or Firm*—Armstrong, Nikaido & Marmelstein

[57] ABSTRACT

A hair-curler of the non-electrothermal type comprising a cage-like tubular core formed at its one end with at least two slots intersecting each other at the center of the end, a hollow cylindrical cover of cellular synthetic resin covering the tubular core, a frame support fitted in the other end of the tubular core and rotatable relative to the tubular core, and a rectangular holding frame having one end pivoted to the support and the other end provided with an engaging projection detachably engageable in one of the slots so that the hair is wound onto the cover while rotating the tubular core relative to the holding frame and is then held to the cover with the holding frame by engaging the projection in the slot. The hair can be readily effectively held in place by the holding frame in the desired angularly displaced position of the tubular core without using a separate hairpin for holding the hair.

8 Claims, 9 Drawing Figures

HAIR-CURLER

BACKGROUND OF THE INVENTION

The present invention relates to women's hair-curlers, and more particularly to hair-curlers of the non-electrothermal type.

At home and beauty parlors, hollow cylindrical hair-curlers for winding hair thereon are generally used to arrange the women's hair or to curl the hair in the desired style. Hair-curlers heretofore used require hairpins for holding the wound hair in place, whether they are those made of steel and having a number of air apertures or those made of urethane foam. The hair is wound onto the cylindrical hair curler by rotating the curler by fingers and is held thereto by a separate hairpin. Accordingly the hairpin must be inserted in place by fingers of one hand while holding the curler by the fingers of the other hand in an awkward position. Thus it is not easy to hold the curled hair. Since a number of hair-curlers are usually used on the head, use of curlers requires an inefficient and cumbersome procedure. Moreover, hairpins are apt to be lost, and curlers are useless without hairpins.

Hair-curlers of another type have already been introduced into use which comprise a hollow cylindrical core and a holding frame pivoted to the core as a substitute for the hairpin. With this type of hair-curlers heretofore known, the holding frame connected to the cylindrical core is not rotatable relative to the core but is merely made pivotable, so that when the cylindrical core is rotated to wind the hair thereon, the holding frame also rotates therewith. Consequently it is frequently impossible to hold the hair by the frame when the core has been rotated to the desired angularly displaced position, because at the position of the cylindrical core where the hair has been completely wound up thereon, the holding frame is not always so positioned as to be pivotable.

SUMMARY OF THE INVENTION

The present invention provides hair-curlers free of the foregoing problems heretofore experienced.

An object of this invention is to provide a hair-curler comprising a tubular core, a cover fitted around the core and a holding frame rotatable relative to the core so that the hair can be readily wound on the cover.

Another object of this invention is to provide a hair-curler comprising a tubular core and a holding frame rotatable relative to the core and pivotably attached to the core, whereby the hair wound on the core can be readily smoothly held in place by the frame without using a separate hairpin which is liable to be lost.

Still another object of this invention is to provide a hair-curler comprising a tubular core formed with at least two slots intersecting each other at the center of one end of the core and holding frame having an engaging projection detachably engageable in one of the slots, so that the engaging projections of the frame can be engaged in the slot of the core at the desired angularly displaced position of the core, permitting the frame to effectively hold the hair always at the desired position where the hair has been completely wound up.

Other objects of this invention will become apparent from the following description given with reference to the accompanying drawings.

DESCRIPTION OF THE PREFERRED EMBODIMENTS

Figure 3:
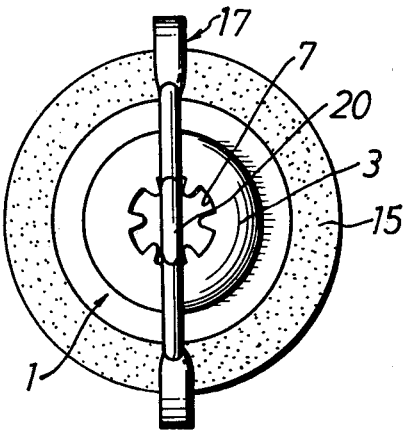
FIG. 3 is a side elevation showing the same as it is seen from the right side of FIG. 1.
Figure 5:
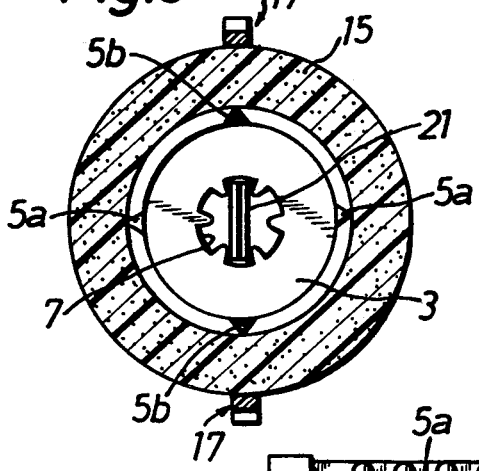
FIG. 5 is a view in section taken along the line V—V in FIG. 1.

FIGS. 1 to 6 show a basic embodiment of the women's hair-curler of this invention. The embodiment comprises a tubular core 1 made of synthetic resin and having a ring 2 and a disc 3 at the opposite ends respectively. Between the ring 2 and the disc 3, annular vertical ribs 4 and straight horizontal ribs 5 arranged at regular spacings are connected together in intersecting manner into a cage-like cylinder having a number of openings serving as air apertures 6. The center portion of the disk 3 is slightly bulged outward and is formed with at least two slots 7 intersecting at the center as seen in FIG. 3. Although the illustrated embodiment has three intersecting slots 7 angularly spaced by 60° about the center of the disc 3, two slots, for example, may be formed which intersect each other at right angles. The slots 7 extending through the disk 3 also serve as a ventilating opening through which the interior of the tubular core 1 communicates with the atmosphere.

The ring 2 of the tubular core 1 is formed in its inner peripheral surface with an annular groove 8 in which a frame support 9 in the form of a synthetic resin disk is detachably fitted to close the ring 2. The frame support 9 is rotatable along the annular groove 8 relative to the tubular core 1. A bracket 10 integral with the support 9 projects outward from the center of the support 9 and has a center groove 11. The cage-like cylindrical core 1 has slight flexibility such that the engaging projection of a holding frame to be described later, while engaging in one of the slots 7, will not be disengaged therefrom when subjected to some tension, shake or like external force. The core 1 also has some rigidity so that when attached to the head with the hair wound thereon, the core will not be deformed. Accordingly the tubular core 1 is not conformable to the shape of the head of the user and is liable to cause discomfort to the user sleeping with the curlers attached to the head. To avoid such objection, the tubular core 1 is provided in its axial midportion with the following guide structure for imparting flexibility.

Figure 1:
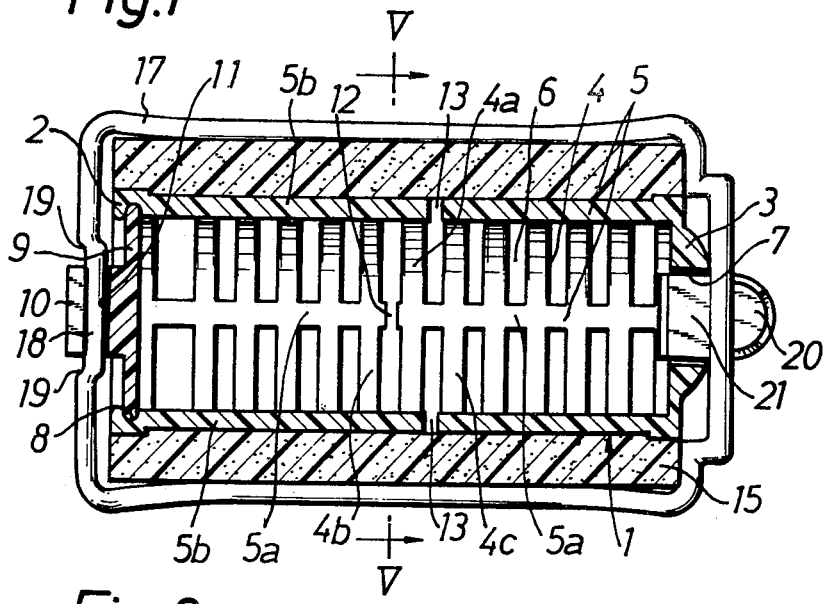
FIG. 1 is a front view partly in section showing a basic embodiment of the hair-curler of this invention in its assembled state.
Figure 2:
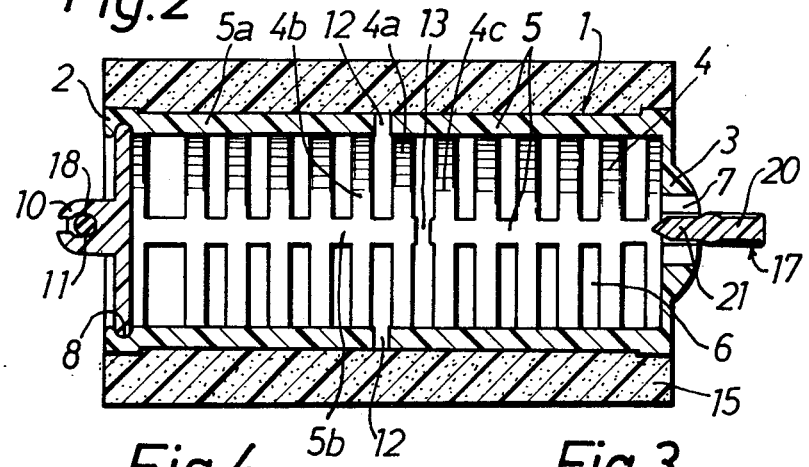
FIG. 2 is a plan view partly in section showing the same in its assembled state.
Figure 4:
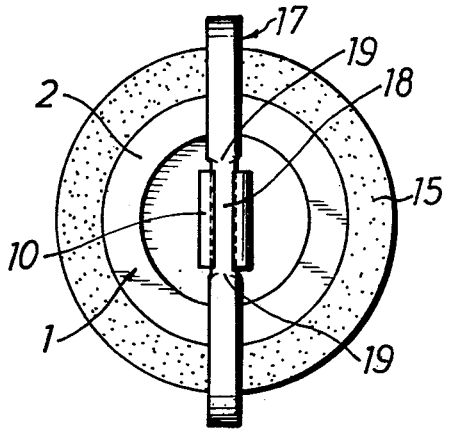
FIG. 4 is a side elevation showing the same as it is seen from the left side of FIG. 1.

The tubular core 1 shown in FIG. 1 comprises eleven annular vertical ribs 4 equidistantly spaced apart in parallel to each other and four straight horizontal ribs 5 which are similarly equidistantly spaced apart in parallel, the ribs 4 and 5 intersecting and being connected to each other into a cage-like hollow cylinder. As will be apparent from FIGS. 1 and 5, a pair of left and right horizontal ribs 5*a*, 5*a* among the four horizontal ribs 5 are cut out at a position between a central vertical rib 4*a* and another vertical rib 4*b* immediately adjacent to the rib 4*a* on the left side thereof. The other pair of ribs 5, namely the upper and lower horizontal ribs 5*b*, 5*b* are cut out at a position between the central vertical rib 4*a* and another vertical rib 4*c* immediately adjacent to the rib 4*a* on the right side thereof. In FIG. 1, the opposed cutouts in the pair of left and right horizontal ribs 5*a*, 5*a* are indicated at 12, while the opposed cutouts in the pair of upper and lower horizontal ribs 5*b*, 5*b* are indicated at 13. Thus the pair of left and right cutouts 12, 12 and the pair of upper and lower cutouts 13, 13 formed in the four straight horizontal ribs 5 are arranged radially symmetrically of the center of the circle of the annular vertical ribs 4, while one pair of the cutouts are displaced from the other axially of the tubular core 1. The cutouts thus arranged give the tubular core 1 greater flexibility at its axial midportion than at the opposite ends thereof. Accordingly when the tubular core 1 is held by fingers at its opposite ends and bent, the core 1 is bendable in any direction substantially with uniform flexibility, affording a better fit to the head of the user. At this time, the cover to be described later for covering the tubular core 1 is of course bendable in conformity with the bending of the core. The number of the cutouts 12 and 13 may be increased, or cutouts of greater size may be provided, insofar as they do not adversely affect the engagement of the projection of the holding frame to be described later in the slot 7 of the core 1.

Figure 7:
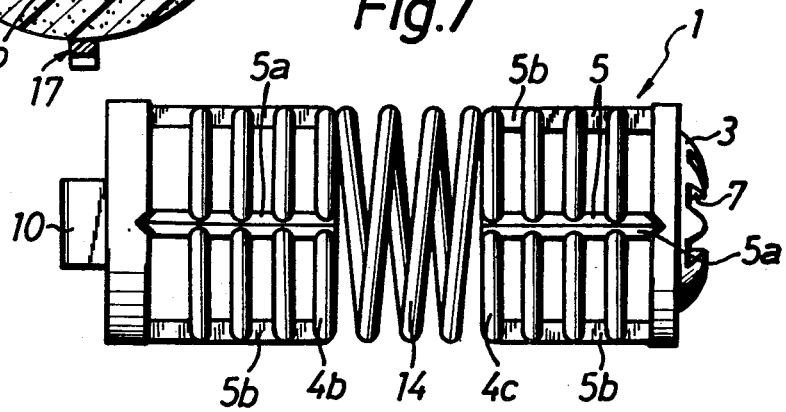
FIG. 7 is a front view showing a modified embodiment of the tubular core only.

FIG. 7 shows a modification of the guide structure for imparting flexibility described above. In this embodiment, the three annular vertical ribs 4 and straight horizontal ribs 5 intersecting and connected to each other in the foregoing structure are replaced only by a helical vertical rib 14 which is provided at the axial midportion of the tubular core 1. As seen in FIG. 7, the helical rib 14 has one end integrally connected to the annular vertical rib 4*b* positioned at the midportion and adjacent to the rib 14 on the left side thereof and the other end integrally connected to the annular vertical rib 4*c* positioned at the midportion and adjacent to the rib 14 on the right side thereof. The pitch and the number of helices of the vertical rib 14 are variable as desired, insofar as an adverse effect is avoided on the engagement of the projection of the holding frame in the slot 7 of the core 1. The modified structure also gives flexibility to the core 1, permitting the core to bend at its axial midportion.

Figure 8:
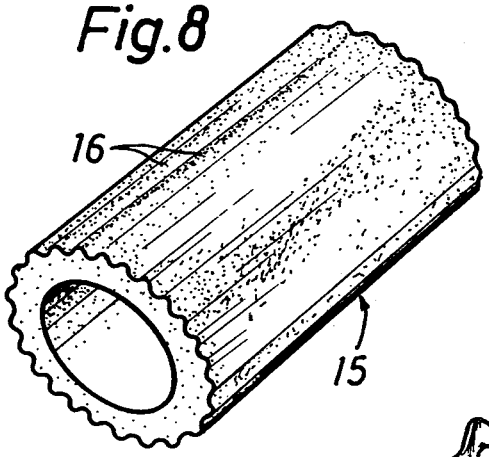
FIG. 8 is a perspective view showing a modified embodiment of the cover only.

A hollow cylindrical cover 15 made of cellular plastic is removably fitted around the tubular core 1 and is rotatable with the tubular core 1. The cover 15 serves as a cushion when the hair is wound onto the curler. The cover 15 included in the embodiment of FIGS. 1 to 6 is one blanked out from tpolyurethane foam in the form of a hollow cylinder having a smooth outer periphral surface. Preferably the cover 15 may be modified as shown in FIG. 8 in which the hollow cylindrical cover 15 of polyurethane foam is provided with a number of axial furrows and ridges 16 on the outer peripheral surface and/or the inner peripheral surface thereof. The furrows and ridges 16 prevent the hair from slipping on the cover 15. Of course, the cross sectional form of the furrows and ridges 16 is not limited to the corrugated form shown in FIG. 8.

A rectangular holding frame 17 is integrally made from synthetic resin and has such size as to surround the cover 15 fitted around the tubular core 1. The rectangular holding frame 17 has a pin portion 18 formed at the midportion of a shorter side thereof and detachably engaged in the groove 11 formed in the bracket 10 on the disk-like support 9. With the pin portion 18 engaged in the groove 11, the holding frame 17 is pivotably supported by the bracket 10 on the support 9, whereby the holding frame 17 can be pivotally raised from the tubular core 1. The holding frame 17 is further formed with a pair of stepped portions 19 for positioning the pin portion 18, a knob 20 outwardly projecting from the midportion of the other shorter side of the rectangular frame 17 and an engaging projection 21 inwardly projecting from the same midportion and integral therewith. The engaging projection 21 is in the form of a flat plate conforming to the slot 7, such that when the holding frame 17 is pivotally moved relative to the tubular core 1, the projection 21 is detachably engaged in the slot 7. Since the holding frame 17 mounted on the support 9 is rotatable relative to the tubular core 1 by means of the support 9, the projection 21 is engageable in the desired one of the slots 7 in accordance with the angular displacement.

Figure 9:
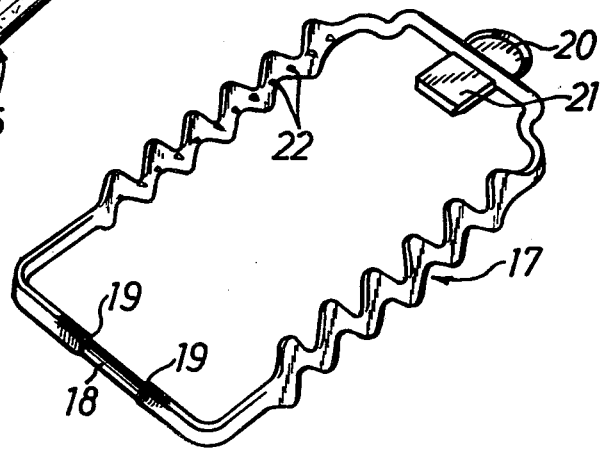
FIG. 9 is a perspective view showing a modified embodiment of the holding frame only.

FIG. 9 shows a modification of the holding frame 17. With this embodiment, the long side portions of the rectangular holding frame 17 have a rounded wave-like form which enables the long side portions to have an increased inner surface area in opposed relation to the cover 15. Moreover the long side portions of the frame are provided on the inside surface thereof with a row of slippage preventing protrusions 22 such as teeth projecting toward the cover 15. When the long side portions of the holding frame 17 have the wavy form and increased inner surface area, the hair wound on the cover 15 can be held in place more effectively without leaving an impression of the holding frame on the hair. In addition, the hair can be held together in uniform arrangement free of uneven bundling. The protrusions 22 provided on both the long side portions of the frame 17 eliminate slippage of the hair even when a small amount of hair is wound on the curler or the frame 17 is in loose engagement with the tubular core 1.

Figure 6:
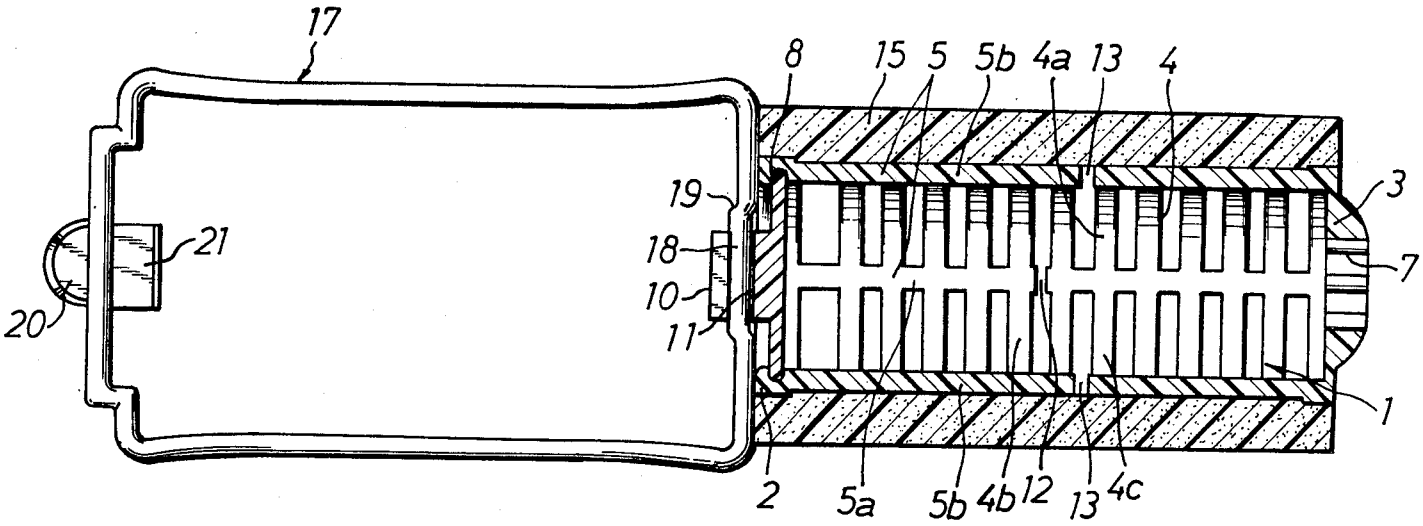
FIG. 6 is a front view partly in section to show the same when a holding frame is in its turned-over position.

The hair-curler of this invention having the foregoing construction is used in the following manner. First the knob 20 of the holding frame 17 is gripped by fingers, and the engaging projection 21 of the frame is released from the slot 7 in the tubular core 1. The holding frame 17 is pivotally turned over as shown in FIG. 6 about the pin portion 18 of the frame 17 received in the groove 11 of the bracket 10 on the support 9. While holding with fingers of one hand the bracket 10 on the support 9 and the frame 17 pivoted thereto, the cover 15 on the tubular core 1 is lightly pressed against the hair, and the hair is wound onto the cover 15 by rotating the cover 15 and the tubular core together by the fingers of the other hand. Since the frame support 9 is held against rotation by the fingers, the tubular core 1 only rotates with the grooved ring 2 guided on the support 9. Consequently the hair can be wound on the cover 15 as desired.

When the hair has been completely wound up, the holding frame 17 is pivotally turned about the pin portion 18 on the support 9 from the position of FIG. 6 to the horizontal position of FIG. 1, and the engaging projection 21 is engaged in one of the slots 7 which is so positioned that the projection 21 is most easily engageable, whereupon the hair wound on the cover 15 is pressed and held together against unwinding by the opposite long side portions of the frame 17. Because the tubular core 1 has one end formed with at least two pairs of slots 7 intersecting each other at the center of the end and the other end to which the rectangular frame 17 is pivoted by the disk-like support 9 rotatably relative to the core 1, the engaging projection 21 of the frame 17 is engageable in the most readily accessible one of the slots 7 at the desired angularly displaced position of the core 1, with the result the hair can be held in place by the frame 17 by pivotally turning the frame, without the necessity of using a separate hairpin for holding the hair.

When the cover 15 is formed with furrows and ridges 16 on its outer peripheral surface, and the long side portions of the holding frame 17 have a wavy form and/or a row of slippage preventing protrusions 22 as described above, the hair can be held more effectively. Since the tubular core 1 is given increased flexibility by the aforesaid guide structure incorporated in its midportion, the core is bendable or flexible at the midportion and is thereby rendered more fittable to the head of the user. This minimizes the discomfort to be experienced when the user sleeps with the curlers attached to the head.

What is claimed is:

1. A hair-curler comprising a cage-like tubular core, a hollow cylindrical cover of cellular synthetic resin covering the tubular core, and a rectangular holding frame pivotally connected to one end of the tubular core and provided with an engaging projection detachably engageable in the other end of the tubular core; the tubular core: (1) being formed at its one end with at least two slots intersecting each other at the center of the end for engaging the engaging projection of the holding frame, the slots being formed in an outwardly bulged center portion of the end which provides a guide surface for the engaging projection of the holding frame; (2) having at its longitudinal midportion a flexible portion bendable with the cover when the tubular core is subjected to an external force at its opposite ends; and (3) having a frame support fittingly retained on the inner peripheral wall of the other end of the tubular core against displacement longitudinally of the tubular core but rotatable circumferentially of the tubular core; and the rectangular holding frame being integral in its entirety and surrounding the cover.

2. A hair-curler as defined in claim 1 wherein each of opposite long side portions of the rectangular holding frame has a rounded wavy form.

3. A hair-curler as defined in claim 1 wherein protrusions are provided on the inner surface of each of the long side portions of the rectangular holding frame.

4. A hair-curler as defined in claim 1 wherein the hollow cylindrical cover is formed on its outer peripheral surface with furrows and ridges extending in parallel axially thereof.

5. A hair-curler as defined in claim 1 wherein the tubular core is made of synthetic resin and comprises a plurality of annular vertical ribs and a plurality of straight horizontal ribs intersecting and connected to the vertical ribs into a cage-like hollow cylinder, the straight horizontal ribs being cut out at an axial midportion of the core between adjacent vertical ribs at the midportion, the cutouts being arranged radially symmetrically of the center of the circle of the annular vertical ribs and displaced from each other axially of the core.

6. A hair-curler as defined in claim 1 wherein the tubular core is made of synthetic resin and comprises a plurality of annular vertical ribs and a plurality of straight horizontal ribs intersecting and connected to the vertical ribs into a cage-like hollow cylinder, the tubular core further including at an axial midportion thereof a helical vertical rib integrally connected at its opposite ends to the annular vertical ribs positioned at the midportion.

7. The hair-curler of claim 1 wherein the rectangular holding frame has in a shorter side thereof a pin portion engageable in a groove of a bracket of the frame support, the holding frame being pivotally movable about the pin portion and restrained axially of the pin portion by stepped portions.

8. The hair-curler of claim 7 wherein the slots at the one end of the tubular core communicate with the interior of the tubular core.

* * * * *